United States Patent [19]

Vulovic

[11] 3,971,090

[45] July 27, 1976

[54] LOADING RAMP SECURING SYSTEM

[75] Inventor: Radoje Vulovic, Swarthmore, Pa.

[73] Assignee: Sun Shipbuilding and Dry Dock Company, Chester, Pa.

[22] Filed: Aug. 11, 1975

[21] Appl. No.: 603,884

[52] U.S. Cl. ..... 14/71.3; 114/.5 BD

[51] Int. Cl.[2] ..... B65G 11/00

[58] Field of Search ..... 14/71, 72; 114/.5 R, 114/.5 BD

[56] References Cited

UNITED STATES PATENTS

| | | | |
|---|---|---|---|
| 9,772 | 6/1853 | Sickles | 14/71 R |
| 47,482 | 4/1865 | Wheeler | 14/71 R |
| 848,862 | 4/1907 | Stern | 14/71 R |
| 1,091,835 | 3/1914 | Goss | 14/71 R |
| 2,372,574 | 3/1945 | Haynes | 14/71 R |
| 3,468,280 | 9/1969 | Williams | 14/71 R X |
| 3,687,308 | 8/1972 | Apelstrand | 14/71 R X |
| 3,879,784 | 4/1975 | Kummerman | 14/71 R |

*Primary Examiner*—Nile C. Byers

*Attorney, Agent, or Firm*—J. Edward Hess; Donald R. Johnson; William C. Roch

[57] ABSTRACT

A system for coupling a loading ramp to a ship which allows a substantial amount of movement of the ship relative to the pier. The end of the loading ramp secured to the ship includes a lever arm coupled to each side of the ramp. Each lever arm includes a foot structure at one end which rests directly on the deck of the ship. The other end of each lever arm hangs via a cable from overhead support structure on the ship.

12 Claims, 4 Drawing Figures

FIG.1.
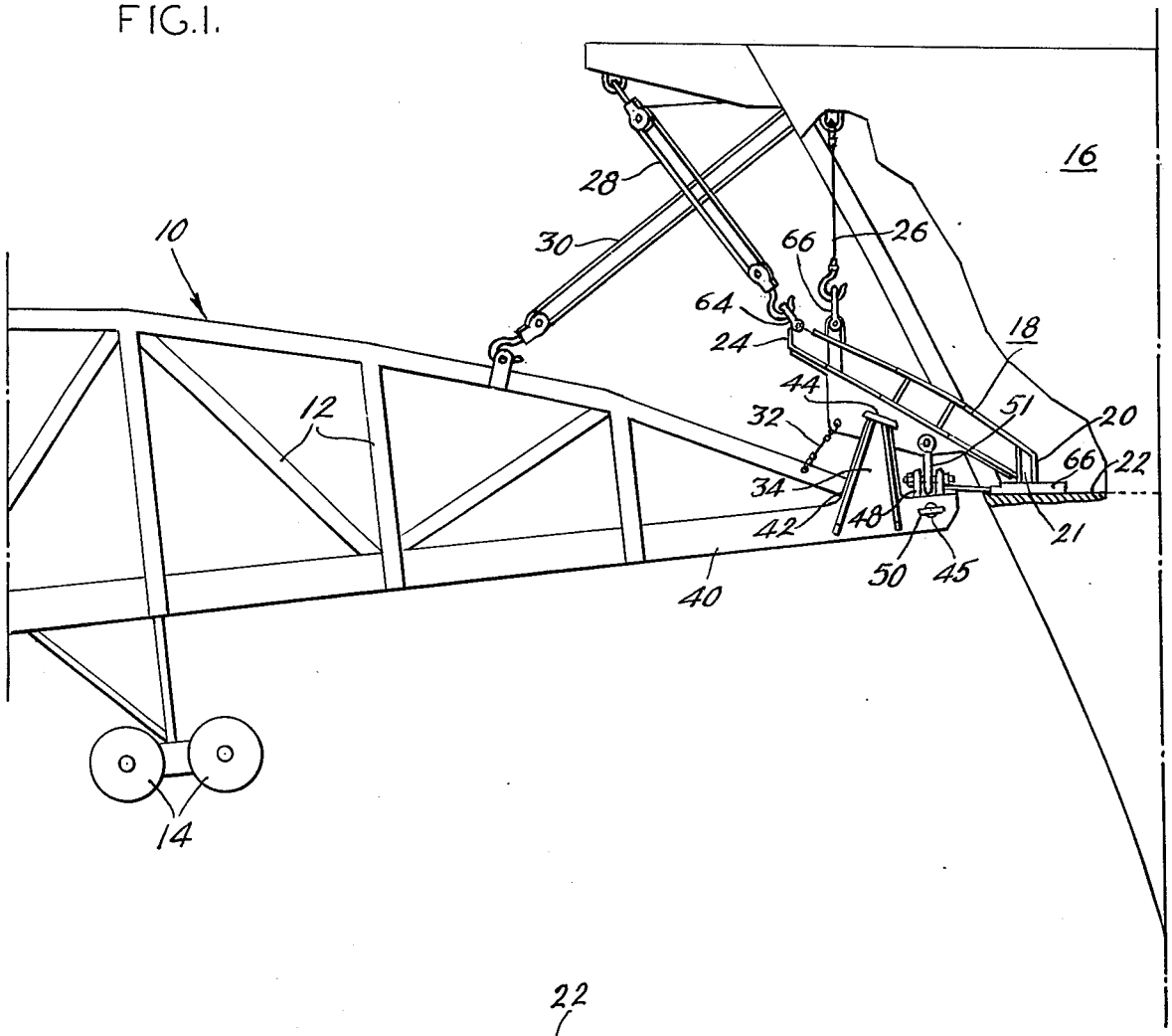
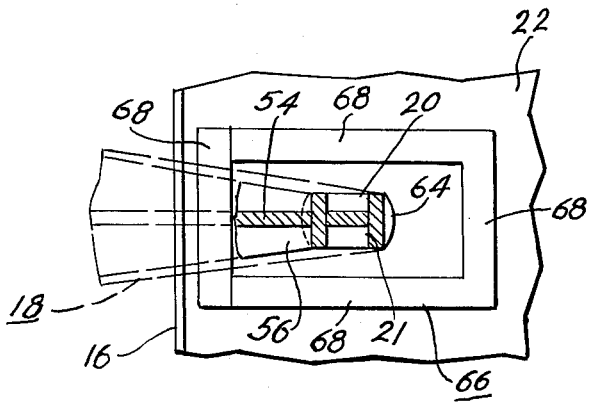
FIG.4.

4.
22
68
64
21
20
66
56
16
48
50
36
45
51
52
3.
18
54
46
43
44
34
40
42
38
12
10
58
53
32
60
62
26
28
24

66
62
56
18
54
58
44
34
43
36
40
38

LOADING RAMP SECURING SYSTEM

BACKGROUND OF THE INVENTION

The present invention relates generally to loading ramps for ships, and more particularly relates to a new and improved system for coupling a ramp to a ship.

On many cargo ships, it has been the practice to secure a loading ramp to a ship by a device such as illustrated in U.S. Pat. No. 3,735,440, issued May 29, 1973 to Hetmanski. Accordingly, many ships are already outfitted with ship related hardware illustrated in that patent. A problem with that ramp has been that movement of the ship relative to the pier, as might be caused by changes in tide, draft, trim, current and wind, have placed a great deal of stress on the ramp coupling system. It would be desirable to have a ramp coupling system which secures the ramp to the ship while allowing, without stress, a substantial amount of movement of the ship relative to the pier. It would also be desirable to have such a ramp coupling system which is compatible with equipment presently on many ships.

SUMMARY OF THE INVENTION

In accordance with a preferred embodiment, a system is disclosed for flexibly coupling a loading ramp to a vessel in which the vessel end of the loading ramp has a lever arm pivotally connected to it on each side. Each lever arm includes means, at its vessel end, for supporting a portion of the weight of the loading ramp on the vessel substantially at the deck height of the vessel, and means at its pier end for hangingly supporting a portion of the weight of the loading ramp from an overhead location on the vessel. The arrangement is such as to allow a great deal of movement of the ship relative to the pier without placing a substantial amount of stress on the coupling system. Also, the ramp coupling system is compatible with equipment presently on many ships.

BRIEF DESCRIPTION OF THE DRAWINGS

FIG. 1 is a side view showing the overall arrangement of one embodiment of the present invention.

FIG. 4 shows a top view of the foot structure of the lever arm and also the support structure on the vessel deck adapted to receive the foot structure.

DETAILED DESCRIPTION OF A PREFERRED EMBODIMENT

Figure 2:
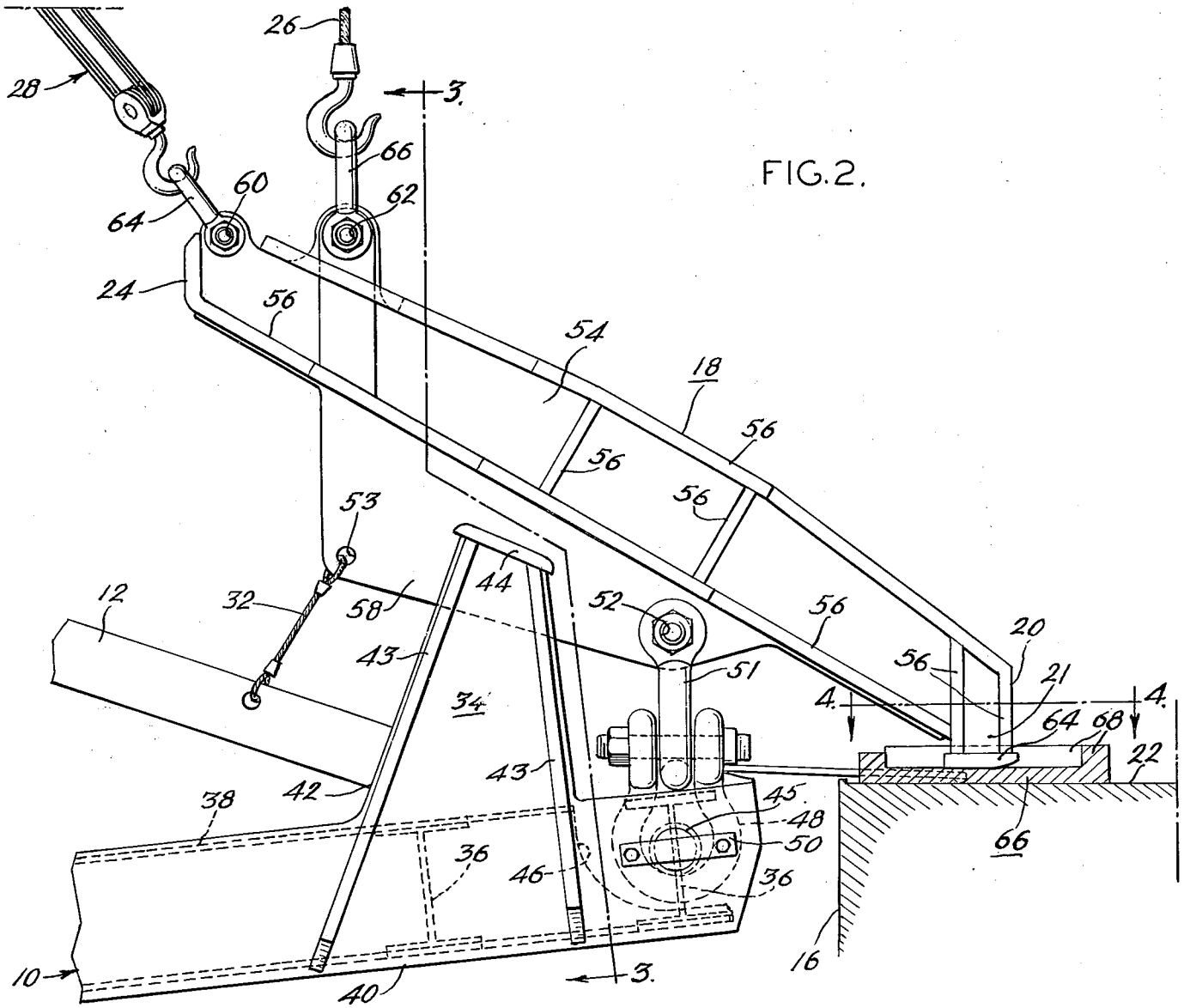
FIG. 2 illustrates a detailed side view of the vessel end of the loading ramp and of the lever arm mounted thereon.

Referring to FIG. 1, there is illustrated a side view of the overall arrangement of one embodiment of the present invention for securing a loading ramp to a ship. The loading ramp 10 includes a truss structure 12 on each side of the ramp to help support the weight placed on it. The ramp also includes support wheels 14 for supporting the ramp on the pier when it is detached from the ship 16. The ramp 10 is secured to the ship 16 by a pair of lever arms 18, one of which is coupled to each side of the ramp 10. Each lever arm 18 is pivotally connected to the ramp 10 by a pair of shackles as shown in FIG. 1 and in more detail in FIG. 2. The vessel end 20 of each lever arm has a footing 21 which rests on the loading deck 22 of the vessel. The pier end 24 of each lever arm is hangingly supported by a cable 26 which is coupled to overhead support structure on the Ship. In the illustrated embodiment, the length of the section of the lever arm between the footing 21 and the attachment point to the ramp is approximately equal to the length of the lever arm section between the point of attachment of cable 26 and the attachment point to the ramp. With this arrangement, approximately one eighth of the weight of the ramp will be supported by each footing 21 and one eighth of the weight of the ramp will be supported by each cable 26. In other embodiments, the lengths of the lever arm sections may be changed which would result in more or less weight being carried by the footings 21 and the cables 26. FIG. 1 also illustrates cable and pulley systems 28 and 30. There are two such cable and pulley systems located on each side of the loading ramp 10. These cable and pulley systems are standard equipment on many vessels, and are utilized during attachment or detachment of the ramp 10 to the vessel 16. By way of explanation, cable and pulley system 28 is utilized to pull the ramp away from the vessel 16, while cable and pulley system 30 is utilized to pull the ramp toward the vessel. Also, simultaneous operation of both of these cable and pulley systems may be utilized to raise and lower the ramp. FIG. 1 also illustrates a cable 32 which runs from the ramp to the lever arm. During attachment or detachment of the ramp to the vessel, this cable prevents the lever arm from swinging in a clockwise direction, as shown in FIG. 1, beyond a predetermined position determined by the length of the cable 32. FIG. 1 also illustrates one of two support structures 34 which are positioned below and on each side of each lever arm 18. These support structures are shown in more detail in FIGS. 2 and 3, and are provided in case of failure of a cable 26. If a cable 26 were to fail, the lever arm would swing in a counterclockwise direction, as shown in FIG. 1, until it encounters the support structures 34, at which time the ramp 10 would be supported at its vessel end solely by the footings 21.

Figure 3:
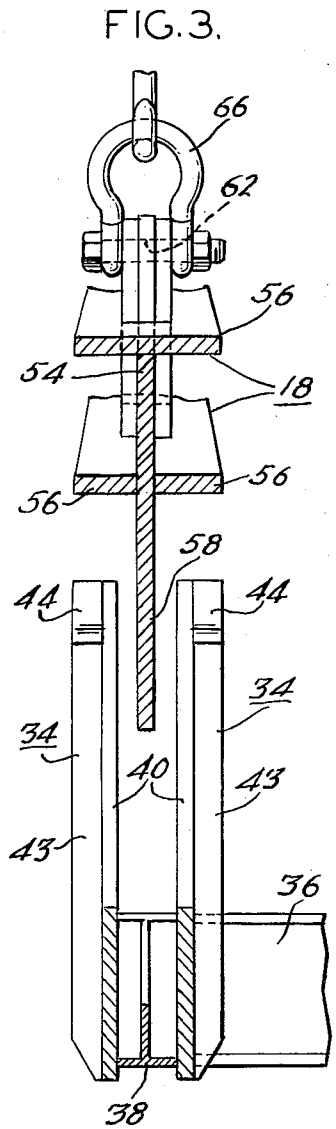
FIG. 3 is a partially cross sectioned view showing further details of the vessel end of the loading ramp and also the pier end of the lever arm.

FIG. 2 illustrates further details of the vessel end of the loading ramp and also the lever arm. The ramp has several transverse I beams 36, shown in dashed lines. The ramp also includes an I beam 38 positioned on each side of the ramp. FIG. 3 is a partially cross sectioned view of FIG. 2, and illustrates an I beam 38 more fully. Two identical plates 40 are welded on each side of the I beam 38, as shown in FIGS. 2 and 3. These plates serve several functions. The truss structure 12 is welded to both plates at junctions 42. The plates also form the support structure 34 which is provided in the event of failure of a cable 26. Each plate 40 has welded thereto several ribs 43 for additional strength and a top rib 44 which the lever arm 18 comes to rest upon in the event of a failure of cable 26. The plates also provide a support for a pin 45 which extends between opposite holes in the two adjacent plates 40. The I beam 38 is cut at its end as illustrated by dashed line 46 to allow pin 45 and shackle 48 to be positioned between the adjacent plates 40. The pin 44 abuts up against one end of transverse I beam 36 and is held in place at its other end by a pin keeper element 50 which is bolted onto the exterior plate 40. The shackle 48 is connected to a second shackle 51 as illustrated and then to the lever arm 18 by a bolt passing through the shackle 51 and a hole in the bottom of the lever arm at 52. The two interconnected shackles 48 and 51 provide a flexible coupling between the ramp and the lever arm.

As shown best in FIG. 2, the vessel end of the loading ramp normally has transition flaps flexibly attached to it to bridge the small gap between the end of the ramp and the ship's deck.

The lever arm 18 is shown in detail in FIGS. 2 and 3. It includes a central plate 54 and rib sections 56 which are welded on for additional strength. The central plate 54 extends downwardly to form a triangular section 58 in which a first hole at 52 is provided, and a second hole at 54 is provided to hold the retaining cable 32. As shown in more detail in FIG. 3, the triangular section 58 is positioned between the two plates 40, and this prevents the lever arm 18 from rotating too much with respect to the ramp structure. Holes are also provided in the lever arm at 60 and 62 to provide for the receipt of shackles 64 and 66 which are utilized respectively to connect via hooks to the cable-pulley system 28 and the main support cable 26. Each of the holes at 52, 54, 60 and 62 may be reinforced by additional plating on each side of the central plate as shown in greater detail in FIG. 3 for hole 62.

The foot structure 21 of the lever arm is shown in more detail in FIGS. 2 and 4. The foot structure includes a bottom plate 64 which is beveled and rounded as shown to provide for some movement of the footing on a footing support structure 66 which may be a plate welded to the deck of the vessel. A retaining edge 68 may be provided around the support plate 66 to prevent the bottom plate 64 from sliding off the foot support plate 66. The upper internal edges of one or more of the retaining edges 68 may be beveled (not shown) to facilitate positioning of the bottom plate 64 within the retaining edge 68 in the initial positioning of the ramp relative to the vessel. The foot support plate 66 and retaining edges 68 may be constructed partly of the hardware already fitted to some ships for the securement of a loading ramp to the ship in a fashion as illustrated in U.S. Pat. No. 3,735,440. It is only necessary to add two more retaining edges to that hardware to achieve the structure illustrated in FIG. 4.

It should be appreciated that the described structure provides a ramp coupling system which secures the ramp firmly to the ship while allowing, without stress, a substantial amount of movement of the ship relative to the pier. As the ship rises and falls with respect to the pier because of changes in tide, draft and trim, the flexibility provided by the footing 21 at one end of the lever arm and the cable support 26 at the other end of the lever arm enables the ramp 10 to pivot easily with respect to the vessel 16. Also, as the vessel changes position along the pier because of movement of the ship due to currents and winds, the flexible couplings of the lever arms 18 to the ramp 10, the flexible couplings of the lever arms to the vessel by cables 26, and the possible movements of footings 21 on the footing support plates 66 all enable the ramp to change, without the substantial stress, its angular position with respect to the vessel.

As illustrated in FIG. 1, the overall design of the coupling system is such as to position cables 28 in a vertical position when the ramp is centrally positioned with respect to the ship. As a result of this design, if the ramp pivots away from its central position the cable will no longer be vertical, and the nonvertical position of the cable will result in a pulling of the ramp back to its central position.

Although at least one embodiment of the present invention has been described, the teachings of this invention will suggest many other embodiments to those skilled in the art.

The invention claimed is:

1. Apparatus for flexibly coupling a loading ramp to a vessel and comprising:

a. a loading ramp having a vessel end adapted to be secured to the vessel;

b. first and second lever arms pivotally connected on opposite sides of the vessel end of said loading ramp, each lever arm being pivotally connected to the loading ramp at a location along its length between vessel and pier ends of the lever arm;

c. said vessel end of each lever arm having means for supporting a portion of the weight of the loading ramp on the vessel substantially at the deck height of the vessel; and d. said pier end of each lever arm having means for hangingly supporting a portion of the weight of the loading ramp from a location on the vessel above the pier end of each lever arm when the loading ramp is secured to the vessel.

2. Apparatus as set forth in claim 1 wherein said vessel end of each lever arm has a foot structure adapted to be placed on the loading deck of the vessel.

3. Apparatus as set forth in claim 2 wherein said pier end of each lever arm includes means for hangingly supporting the pier end of the lever arm from a cable means.

4. Apparatus as set forth in claim 3 wherein each lever arm is pivotally connected to the loading ramp by at least one shackle.

5. Apparatus as set forth in claim 1 wherein said pier end of each lever arm includes means for hangingly supporting the pier end of the lever arm from a cable means.

6. Apparatus as set forth in claim 1 wherein each lever arm is pivotally connected to the loading ramp by at least one shackle.

7. Apparatus for flexibly coupling a loading ramp to a vessel and comprising:

a. a vessel having a deck onto which cargo is to be loaded and unloaded;

b. a loading ramp having a vessel end adapted to be secured to the vessel;

c. first and second lever arms pivotally connected on opposite sides of the vessel end of said loading ramp, each lever arm being pivotally connected to the loading ramp at a location along the length of each lever arm between vessel and pier ends of the lever arm;

d. said vessel having means for supporting the vessel end of each lever arm at substantially the deck height of the vessel;

e. said vessel further including means for hangingly supporting the pier end of each lever arm from a location above the pier end of each lever arm when the loading ramp is secured to the vessel.

8. Apparatus as set forth in claim 7 wherein said means for hangingly supporting the pier end of each lever arm includes a cable means extending from the vessel to the pier end of each lever arm.

9. Apparatus as set forth in claim 8 wherein said means for hangingly supporting the pier end of each lever arm includes means for holding each of said cable means in a substantially vertical position when the ramp is centrally positioned with respect to the vessel.

10. Apparatus as set forth in claim 7 wherein said vessel end of each lever arm has a foot structure adapted to be placed on the loading deck of the vessel.

11. Apparatus as set forth in claim 10 wherein said means on the vessel for supporting the vessel end of each lever arm includes a support area on the vessel deck for each said vessel end, each said support area having a raised lip around its circumference to retain the vessel end of the lever arm in the support area.

12. Apparatus as set forth in claim 7 wherein said loading ramp includes a raised support structure positioned beneath each lever arm to limit movement of the lever arm in the event said means for hangingly supporting the pier end of the lever arm should fail.

* * * * *